United States Patent [19]

Falkenberg

[11] 3,938,289

[45] Feb. 17, 1976

[54] CONSTRUCTION ELEMENTS AND SHEET METAL WEB STRIPS THEREFOR

[76] Inventor: Johan Caspar Falkenberg, Fjordveien 59C, N-1322 Hovik, Norway

[22] Filed: Aug. 15, 1974

[21] Appl. No.: 497,828

Related U.S. Application Data

[63] Continuation-in-part of Ser. No. 327,924, Jan. 30, 1973, Pat. No. 3,872,641.

[30] Foreign Application Priority Data

Jan. 31, 1972 Norway ..... 228/72
June 29, 1972 Norway ..... 2328/72

[52] U.S. Cl. ..... 52/618; 85/11; 85/13
[51] Int. Cl.[2] ..... E04B 2/28
[58] Field of Search ..... 52/615, 618, 731; 85/11, 85/13

[56] References Cited

UNITED STATES PATENTS

| | | | |
|---|---|---|---|
| 2,129,441 | 9/1938 | Otto | 52/615 X |
| 3,224,154 | 12/1965 | Toti et al. | 52/731 X |
| 3,431,810 | 3/1969 | Black | 85/11 |
| 3,538,668 | 11/1970 | Anderson | 52/615 |

*Primary Examiner*—Frank L. Abbott
*Assistant Examiner*—Carl D. Friedman
*Attorney, Agent, or Firm*—Watson, Cole, Grindle & Watson

[57] ABSTRACT

In construction elements comprising two parallel plates of nailable material and one or more webs of elongated sinuous metal sheeting extending edgewise between the plates and having teeth at the edges driven into the plates, the metal strips used for the webs are shaped in an improved manner to enhance strength characteristics.

12 Claims, 18 Drawing Figures

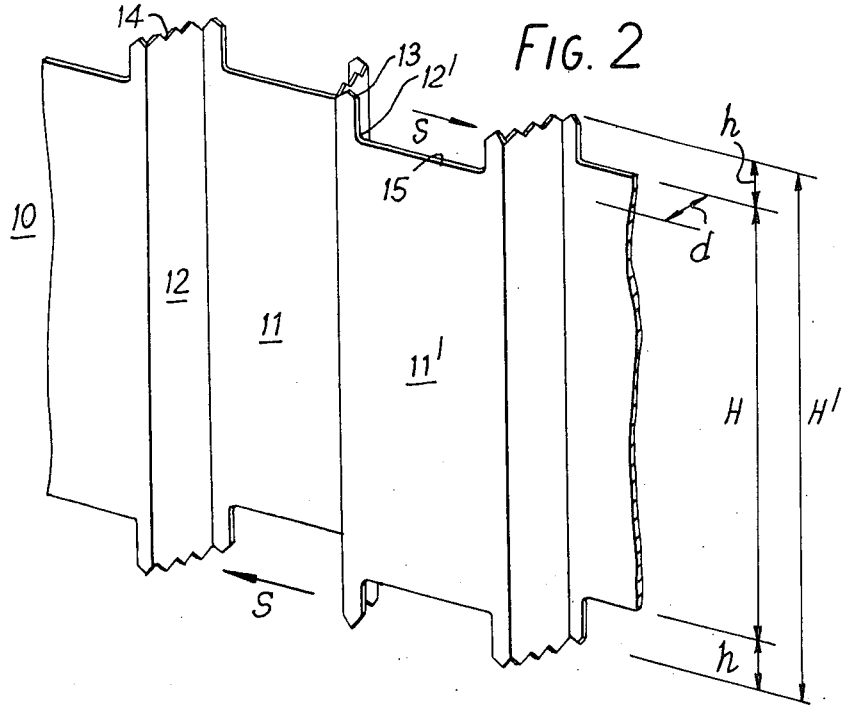
FIG. 2
FIG. 3
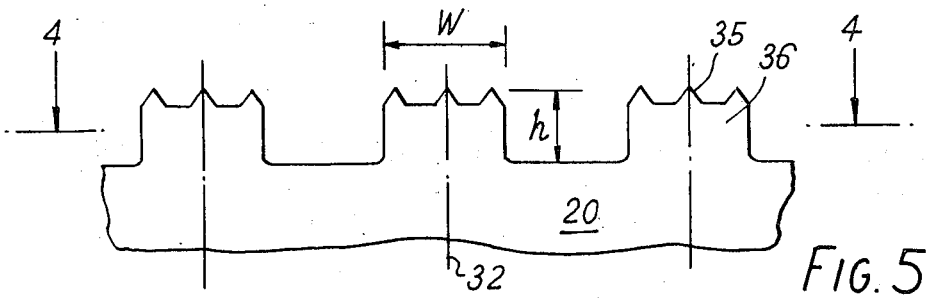
FIG. 4
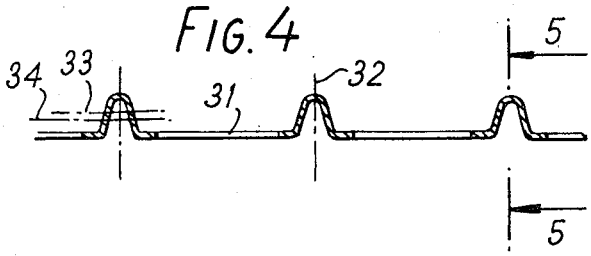
FIG. 5
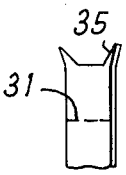

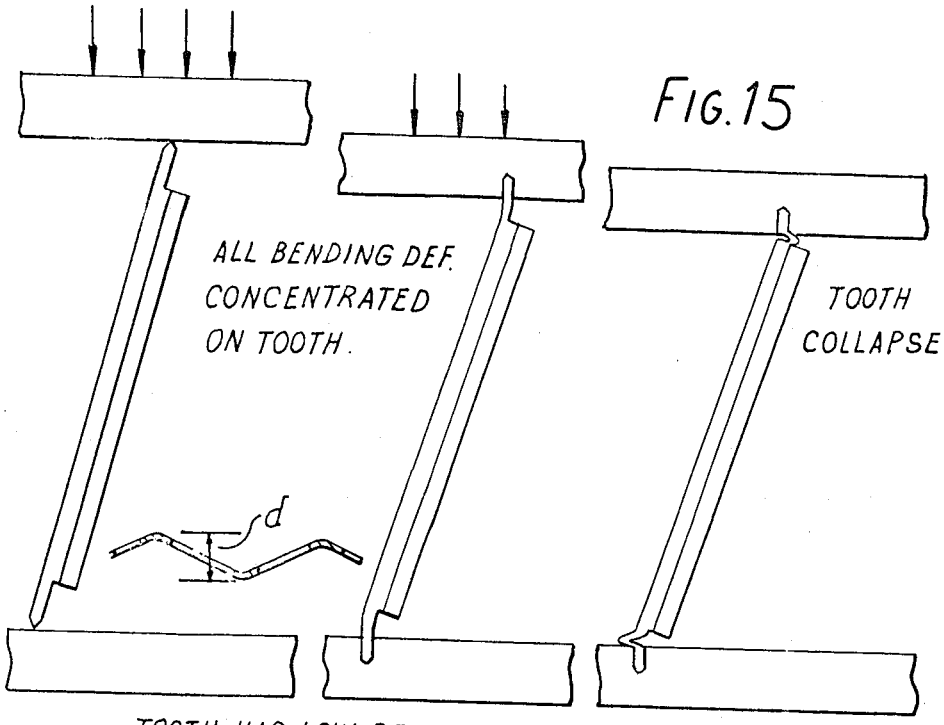
TOOTH HAS LOW BENDING STIFFNESS COMPARED TO WEB
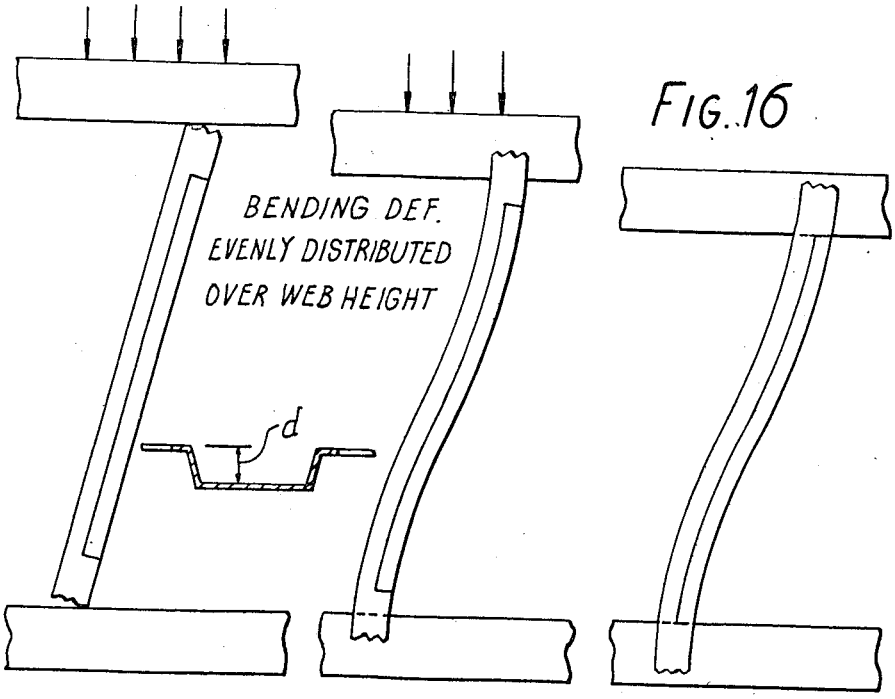
TOOTH HAS APPROX. SAME BENDING STIFFNESS AS WEB.

CONSTRUCTION ELEMENTS AND SHEET METAL WEB STRIPS THEREFOR

This application is a continuation-in-part of my copending application Ser. No. 327,924 filed Jan. 30, 1973, and now U.S. Pat. No. 3,872,641.

BACKGROUND OF THE INVENTION

The invention herein relates to construction elements of the kind comprising two plates of nailable material and at least one web which keeps the plates in spaced parallel positions. The material of the plates may be solid wood, for example sawed boards, or plywood, chipboard, wood fibre board or the like. Elements of the said kind may be made with one, two or more webs and also be of various design in other respects, for example as I-, H- or box beams or as larger panel elements adapted for various purposes. In particular such elements are used in the form of so-called "stressed-skin" elements as load-supporting floor and roof elements, mostly of closed, box-like shape and filled with insulating material, in which case the webs are most frequently constituted by wooden joists to which the plates are nailed and/or glued so as to form upper and lower beams in the structure.

However, it is also known to make elements of the kind mentioned above with webs in the form of elongated sinuous metal sheets, preferably steel sheets, which along the lateral edges are formed with pointed teeth which are pressed into the plate members. A structure of this kind is disclosed in the German published patent specification No. 1,004,790 (Hess) of 1954. In the form shown and described in that publication this concept, however, is of little practical interest, the attachment of the web sheet in the plate affording little resistance to separating forces and, for such reason, the plates must be held together by bolts passing therethrough.

In the U.S. Pat. No. 3,538,668 (Anderson) it has been proposed to increase the pull-out force, i.e. the resistance of the teeth to being pulled out of the plates, by bending the teeth alternately to opposite sides like the teeth of a saw blade, so that, when pressed in, they will be further deflected so as to be locked in the wood plate. At the same time it is proposed to reinforce the teeth locally by giving them an angular cross-sectional shape. However, in this case the teeth are subjected to considerable bending during assembly, so that they must be made very short in order not to collapse. Especially with hard fibre board and chipboard of qualities at present manufactured as floor boards, it has turned out to be very difficult to achieve a satisfactory connection in this manner with the use of economically justifiable steel qualities and thicknesses.

There are also known fastener elements for joining together two pieces of wood lying one on top of the other. One such fastener element, which is disclosed in U.S. Pat. No. 3,458,518 (Heise) consists of a strip of sheet metal which along opposite edges is formed with pointed teeth that are to be pressed into the opposite wooden members, thus forming a hidden connection. The teeth disclosed in this patent are long and slender, about 3 to 4 times as long as they are wide, and are stiffened by one single bend along the tooth axis, so that the teeth aquires a shallow V- or U-shaped section.

In U.S. Pat. No. 3,736,718 (Sylvan) is disclosed a stud or a post member in the form of a rod-like element of sheet metal, with a Z-shaped cross section. At the ends of the rod are formed pointed teeth, also stiffened by one bend along the tooth axis and thus having a shallow V- or U-shaped section. The rod is designed to function as a post member or a stiffening rib in a framework for a wall panel, and is capable of taking axial compression and some transverse bending, but is not a shear transferring member. The pointed teeth have negligible stiffness compared to the stud member proper.

For the reasons given in detail below, none of the teachings of the above mentioned patents forms a basis for the design of a web member in the form of a continuous sheet metal strip, that meets the technical and economical requirements essential for a commercial exploitation.

SUMMARY OF THE INVENTION

A sheet metal web element that is to serve as a force transferring member in a load bearing beam or panel structure of the above kind must fulfill a number of functional requirements.

Firstly, the metal thickness must be sufficiently small to give an economically competitive product, and when used for insulating panels, to keep the heat loss within the limits specified by building regulations. This means that for panels used for normal residental housing, the sheet thickness should not be above 0.5 mm (U.S.S. Gage 25–26).

Secondly, the teeth that are to be pressed into the flange plates must be able to penetrate to such a depth that they are properly anchored in the flange material and that the shear and pull-out forces that are to be resisted do not merely cause a shallow plug of the flange material to be torn or sheared off. This is particularly important with flange materials that are weak in lamellar tearing, such as particle board.

Thirdly, the teeth must be shaped in such a way that the horizontal shear force does not cause the tooth to cut horizontally like a knife edge into the flange material, but rather is transmitted through a broad, abutting tooth surface oriented transversely to the direction of the shear force and the longitudinal direction of the web, so that no appreciable displacement takes place between the tooth and the flange material under normal loads in use.

Fourthly, the teeth must have sufficient bending stiffness, in all directions, so as not to collapse during the pressing operation, and to resist the additional bending stresses that arise when the web is not placed exactly perpendicularly between the flange plates. Also, the teeth must sustain quite considerable impact forces during handling and shipping of large coils of web strip, containing 100 m or more.

Fifthly, there must be formed along the web edge, between the penetrating teeth, straight portions of sufficient extension to stop the penetration when it has proceeded to the intended depth along one edge of the web while the teeth along the other edge have not yet been pressed all the way into the other flange.

In general, the two flange plates will not offer exactly the same resistance to penetration, and therefore the teeth along the respective edges will not penetrate at the same rate. Furthermore, such stopping or abutting portions must be sufficiently extensive to prevent the web from shearing further into the flange material in those regions where the panel in use is subjected to concentrated forces, such as reaction forces from the supporting structure. Also, such intermediate, non-cutting portions between the teeth ensure that the integrity of the flange plates is not unduly impaired as it would be by a continuous cut.

Sixthly, the shape of the sheet should be such as to make it possible within tolerable limits and without complicated measures to keep the sheet straight in the desired position by stretching it when the pressing operation commences. This is desirable because the web as manufactured on a commercial scape will normally have unintentional twists and curvatures that have to be straightened out. In order to lend itself to such straightening without undesired deformation, the strip should be formed with as shallow undulations as are compatible with strength requirements.

As a seventh consideration is mentioned the desirability of shaping the web strip in such a way that webs running at right angles to each other may be joined in a simple manner avoiding time-consuming manual work. This is especially important for the manufacturing of closed panels, or panels having two-way stiffness.

Some more secondary considerations might be mentioned, such as shaping the web strip in a manner permitting compact coiling, and with a suitable modular measure, such as 100 mm (4 inches) for the strip corrugation period.

None of the above requirements has to any appreciable extent been fulfilled by the earlier proposals disclosed in the Hess or Anderson patents, and neither of these has been developed into a marketable industrial product.

The present invention has for a general object to improve construction elements of the kind set out above, as well as the metal strips to be used for the webs of such elements, primarily in such respects as explained above. It will be understood that the invention extends to the construction elements whether open or closed and whether filled with insulation or not, as well as to the shaped metal strips whether of great lengths in coiled form or cut to desired lengths for use in assembling the elements.

A more specific object of the invention is to provide shapes of webs and teeth which fulfill most or all of the above requirements, and which for the first time enable large, load bearing stressed skin panels of the type in question to be produced industrially, and thus represent a significant contribution to the prefabricated housing industry.

This is primarily achieved by shaping the web with broad, substantially rectangular teeth, separated by intermediate straight root-line portions, and forming in each tooth two or more folds in alternating directions, which run transversely through the web strip from the tip of one tooth to the tip of the oppositely placed tooth, so that the web and the teeth will have a common stiffening sectional shape aligned in the direction of insertion. By shaping the teeth with two or more reverse folds, the teeth can be made so wide that they extend over the whole web profile depth and thus obtain the same local bending stiffness as the web sheet itself. Due to this shape the teeth, even with a very small sheet thickness, aquire ample strength to resist rough handling and very high penetration pressures, and may be given ample embedding length without bending or collapsing.

Furthermore, the proposed web shapes enable the web strips to be tensioned, when setting up a panel for pressing, to such an extent that undesired bends and twists in the web strip straighten out and the web strip stands as a straight, tensioned ribbon, within sufficiently close limits of the exact position to avoid tooth collapse during pressing or a bad appearance of the finished panel.

Further objects and features of the invention will be apparent from the following specification when read with reference to the attached drawings, which by way of example illustrate useful embodiments of construction elements and sheet metal web strips therefor made in accordance with the invention.

BRIEF DESCRIPTION OF THE DRAWINGS

In the drawings

FIG. 2 is a broken perspective view of a strip of metal sheeting made in accordance with the main features of the invention and adapted to be used in a construction element such as that shown in FIG. 1.

FIG. 3 is a view in elevation of an edge portion of a metal blank before folding into the desired web shape illustrating in FIG. 4 according to a second embodiment of the web strip.

FIG. 4 is a sectional view of the same, taken along the line 4—4 in FIG. 3, after folding.

FIG. 5 is a sectional view taken along the line 5—5 in FIG. 4.

FIGS. 15 and 16 are explanatory diagrammatic views illustrating deformations liable to occur in the webs of construction elements not made and made in accordance with the invention, respectively.

DETAILED DESCRIPTION OF THE PREFERRED EMBODIMENTS

Figure 1:
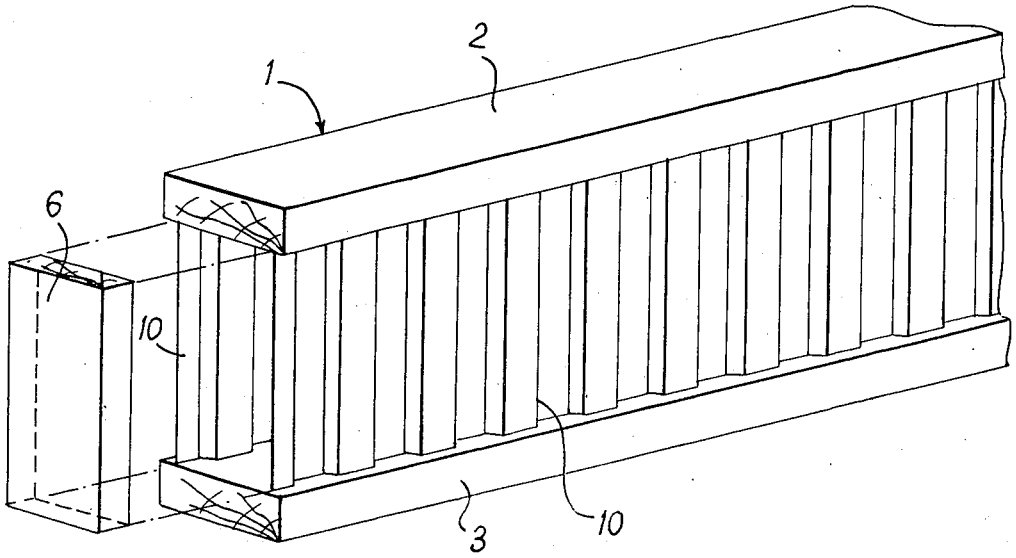
FIG. 1 is a broken perspective view of an embodiment of the construction element according to the invention.

FIG. 1 illustrates a construction element 1 which may be made in accordance with the invention and may be used as a beam in a buildng structure. The beam 1 comprises two elongated wooden flanges 2 and 3 held in spaced parallel positions by two spaced trapezoidally corrugated web members 10 of sheet metal so as to form an open-ended beam with box-shaped cross-section. The ends of the beam should preferably be closed, for example with a piece of wood 6 which is fitted into it and nailed to the end portions of the webs. This will serve to transmit part of the vertical reaction forces at the beam ends through the closure piece 6 and into the webs, the other part of the reaction force being transmitted through bearing pressure between the flange material and the tooth ends and shoulder portions of the webs. Furthermore, such end closure appreciably increases the torsional stiffness of the beam and gives the beam high dimensional stability, resisting distortion caused by the tendency of the timber flanges to warp upon drying.

In FIG. 2 is shown in perspective view a short length of a web strip 10 with transverse, trapezoidally shaped corrugations, consisting of flat, parallel portions 11, 11' and inclined transverse portions 12, 12'. The strip is formed with teeth 13 that are aligned with the web sheet and extend outwardly of the edges thereof. The teeth have a broad, rectangular shape and are so placed that they extend throughout and beyond the transverse portions 12 and 12' thereby aquiring a Z-shaped cross-section. The terminal edge 14 of the tooth preferably has a saw-tooth configuration which enables the tooth to cut neatly through the flanges 2 and 3 in FIG. 1, which may be timber, plywood or particle board. The teeth are separated by intermediate, straight root-line portions 15 which stop the teeth from penetrating further than intended into the flanges, and also ensure that the flange plates are not excessively weakened by the cutting action.

The broad, Z-shaped teeth have ample strength to resist high penetration pressures, and may be given sufficient length to ensure that they penetrate deeply enough into the flange plates to permit transmission of a horizontal shear force, S in FIG. 2, the magnitude of which will be limited by a shearing failure of the tooth material rather than a shallow plug of the flange material being torn out of the flange. Also, since the force S is transmitted through the broad transverse surface of the tooth, the tooth will not have the tendency to shear horizontally into the flange material, and the joint between web and flange will exhibit negligible deformations, even for quite substantial working stresses, which is highly beneficial for load-bearing structures where strength and stiffness are of primary importance.

The web profile depth *d* should be such as to give the web sufficient bending stiffness to avoid column buckling of the web during the pressing operation. On the other hand, in order to have good tensioning capability as explained above, the profile depth *d* should be as small as is compatible with the column strength requirement. By theoretical analysis and practical experiments, it has been found that a suitable minimum dimension for *d* is about one-twentieth of the total web height H'. Considering that the penetration depth of the teeth is restricted by the thickness of the flange plates and also with a view to reducing heat transfer and weakening of the plates, these considerations result in a width of the teeth as measured along the sinuous outline of the sheet greater than their length (height) *h*, whereby the tooth will have a great buckling resistance and afford a large frictional area and hence a high pull-out force relative to the penetration depth.

Figure 11:
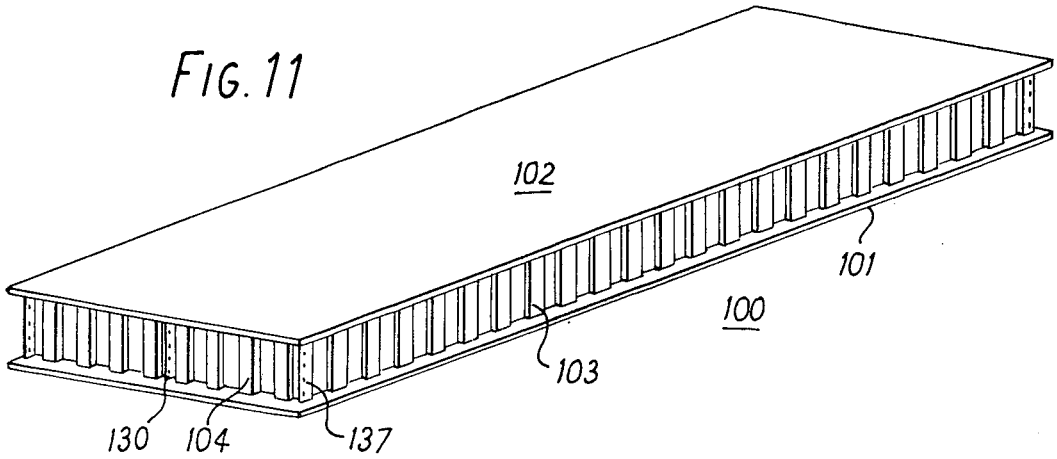
FIG. 11 is a perspective view of a construction element having webs made in accordance with FIGS. 8, 9 and 10*a*, *b* and *c*, and constituting a preferred embodiment of a closed element.

Since the teeth 13 extend over the full profile depth *d* of the web strip, they have approximately the same bending stiffness as those parts of the web proper which extend between the oppositely placed teeth. This balanced stiffness distribution has been found to be of decisive importance when large panel elements, of the type shown in FIG. 11, are to be produced industrially. It is not possible to ensure that the web strip, when the pressing operation commences, is placed in an exact vertical position between the flange plates. Deviations up to, say, 1:20 must be expected. This situation is illustrated, schematically and exaggerated, in FIGS. 15 and 16 for two different tooth and web configurations. As illustrated, the deviation of the web strip from the correct vertical position causes a certain amount of bending deformation in the web and teeth. With the type of teeth shown in FIG. 15 which are the type of teeth known from the above mentioned Heise and Sylvan patents, which have only a fraction of the bending stifness of the web proper, all the bending deformation is taken up by the teeth which act as flexible joints and eventually collapse. With the broad, multiple fold teeth of FIG. 16, however, the bending deformation is evenly distributed over the teeth and web, and no collapse occurs.

In FIG. 3 is shown the edge portion of a sheet metal blank 20 for a web strip which is shown in longitudinal section in FIG. 4. As will be seen, the web strip has aligned plane portions 31 separated by sharp inward bends formed symmetrically with respect to the central axis 32 of the teeth. This shape is well suited for the outer webs in panel elements of the type shown in FIG. 11 with the flat portions 31 facing outwards so that there is obtained a maximum overall aligned sheet area which makes sealing and insulating between adjacent panels simpler than with the trapezoidally corrugated shape. However, the shape shown in FIG. 4 is less efficient with regard to column strength, since the centroidal axis 33 of the teeth does not coincide with the neutral axis 34 of the web, thus giving rise to some bending of the web during pressing, which will lead to column buckling if the web height H' exceeds a certain limit. This shape is suitable for short and moderate span panels, since the web height H' should not exceed 150 mm with a sheet steel thickness of 0.5 mm.

FIG. 5 which is a vertical section 5—5 through the tooth in the FIG. 4 embodiment shows how the small triangular tips 35 of the teeth 36 may be set so as to deform during the pressing and form a better anchor for the tooth and thus increase the pull-out resistance of the teeth. Tests have indicated that this leads to about 40 percent increase in the pull-out resistance, which in general is beneficial. However, the bending deformation of the tooth tips that takes place during the pressing increases the "spring back", i.e. the small distance that the panel flanges move apart after the jointing pressure has been released. This spring-back is for particle board about 0.7 mm when the teeth are straight, and about 1.2 mm when the tips of the teeth are set. In the latter case, it has been found that the spring-back varies somewhat from one part of the panel to another, so that the dimensional tolerances cannot be kept so narrow as is the case with entirely straight teeth. Also should be taken into consideration that the press tool for producing webs with set teeth will be more complicated to manufacture and maintain. These negative factors may in some cases outweigh the advantage of the increase in pull-out resistance.

Figure 6:
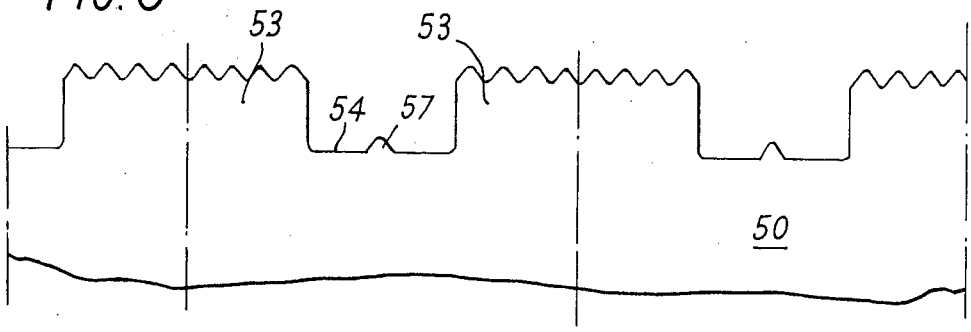
FIGS. 6 and 7 are views corresponding to FIG. 3 and 4, respectively, for a third embodiment of the web strip.

FIG. 6 shows the edge portion of a sheet blank 50 with very wide teeth, the flat-width to length ratio w:h being about 3:1. This blank is suitable for the web shape shown in FIG. 7. The straight root-line portion 54 between consecutive teeth 53 is formed with a small triangular protrusion 57 in the middle. The purpose of this protrusion is to stabilize the flat portion 54 as this is pressed towards and eventually a very short way into the flange plates. This prevents a local buckle from forming in the flat portion 54.

Figure 7:
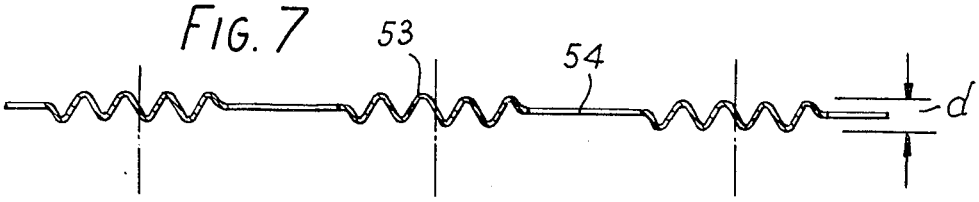

The web strip shown in FIG. 7 and formed from the blank shown in FIG. 6, has very broad teeth with several folds in alternating directions, forming a zig-zag tooth section. In this case, the centroidal axis of the teeth coincides with the neutral axis of the web proper, so that this shape has better column strength than the web shown in FIG. 4. This shape, however, is primarily characterized by having very high shear strength and stiffness, due to the large shear area of the teeth. This web is suitable for making tube-like beams, where the flanges are sawn lumber, e.g. 2 inches × 4 inches separated by two webs in spaced apart relationship, thus forming a double I-section like the one shown in FIG. 1.

Figure 8:
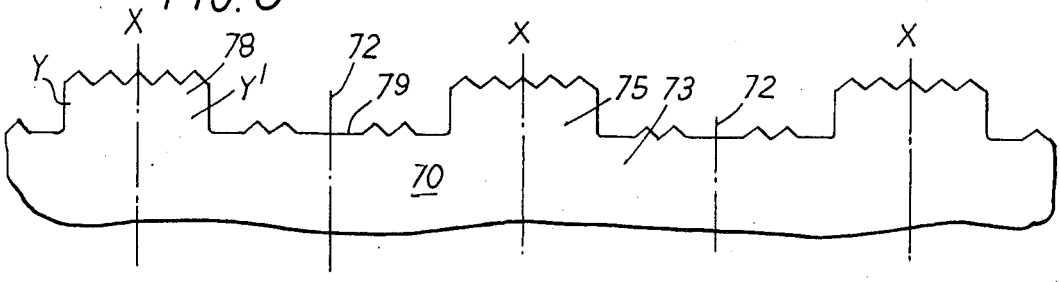
FIGS. 8 and 9 are correspondng views for a forth embodiment which constitutes a further development of that shown in FIG. 2, and at present is regarded as preferred.
Figure 9:
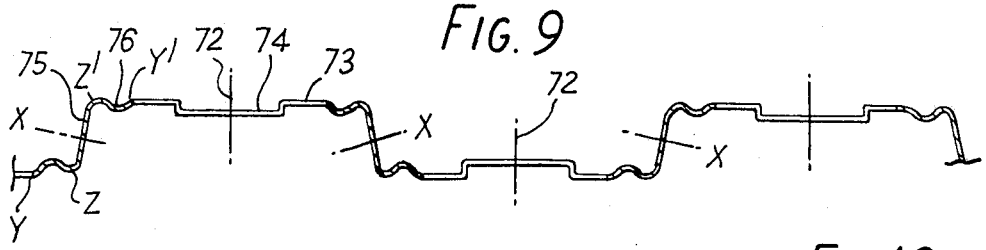

In FIGS. 8 and 9 are shown, respectively, a portion of a sheet blank 70 and the longitudinal section for a web strip that is particularly well suited for making completely closed panel elements of the type shown in FIG. 11, and which has particularly strong teeth. This web shape is a further development of the trapezoidal section with Z-shaped teeth that is shown in FIG. 2.

In the longitudinal portions 73 there is formed near the transition to each transverse portion 75 a stiffening groove 76. The function of this is primarily to give the edge portions 78 of the teeth a local stiffening, so that these parts may be made considerably wider than what is shown in FIG. 2 without the free edges Y, Y′ collapsing during the pressing operation. Such broad flange portions of the Z-shaped teeth also contribute considerably to the strength of the teeth with regard to bending transversely to the portions 75, which obviously is the weak direction for the tooth shown in FIG. 2. Also, the shear strength and shear stiffness of the tooth is markedly increased due to the larger shear area, and the pull-out resistance of the tooth is increased in proportion to the increase in the tooth surface area.

Symmetrically with respect to the central cross-sectional planes 72 of the longitudinal portions of the web, these are formed with shallow troughlike recesses 74. The object of these is firstly to afford a local stiffening of these portions 73, which otherwise might be subject to buckling during pressing because of their relatively large width. Secondly, a troughlike recess 74 can serve as a starting point for making a narrow channel, whereby an adjacent web sheet extending at a right angle to the web sheet 70 can be joined with the same.

Figure 10A:
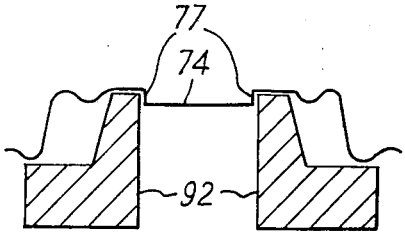
FIGS. 10*a*, *b* and *c* are sectional detail views showing successive steps in the forming of joints between web sheets made in accordance with FIGS. 8 and 9 and extending at right angles to each other.
Figure 14:
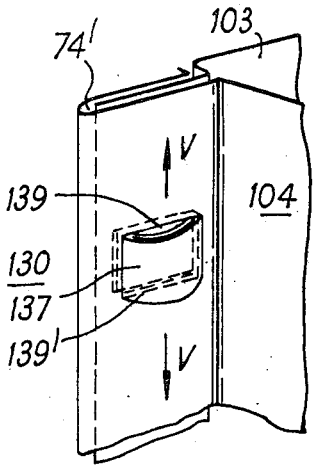
FIG. 14 is a perspective detail view of a joint between a longitudinal and a transverse web in the element shown in FIG. 11.

This is illustrated in the FIGS. 10*a*, *b* and *c*. By means of a tool comprising a pair of jaws 92, which are movable towards each other and are made to engage the outer side faces 77 of the trough, the trough 74 is pinched together so as to form a narrow channel 74′ into which the adjacent web sheet 90 can be inserted in order thereafter to be locked to the sheet 70 by riveting or spot welding or also by a punching operation as will be explained later with reference to FIG. 14.

FIG. 11 shows a construction element 100 in the form of a closed box with bottom 101 and top 102, for example of chipboard, and with sides of web sheet of a form as shown in FIGS. 8 and 9, but shown with flat surface portions for simplicity of illustration.

The element 100 may be filled with insulation and for example be used as a floor or roof element in a house. The element 100 is placed in self-supporting position in its longitudinal direction and along the side edges of the top plate 102 it may, if desired, be shaped with groove and tongue sections, respectively (not shown), so as to facilitate jointing of elements.

Figure 12:
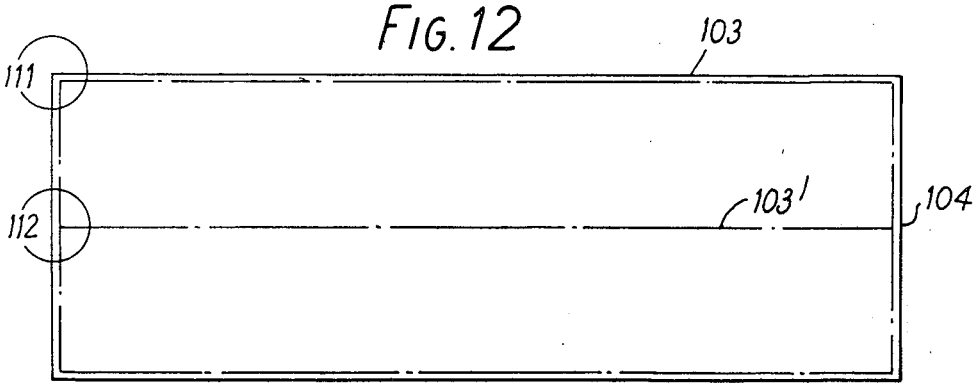
FIG. 12 is a diagrammatic top view of the FIG. 11 embodiment.

FIG. 12 illustrates diagrammatically the location of the web sheets. These have been indicated by dash-and-dot lines, and it will be seen that in addition to web sheets 103 and 104 along the longitudinal and terminal edges, respectively, there is inserted a central longitudinal web sheet 103′. A convenient spacing of longitudinal web sheets may be about 57 cm for an overall element width of 120 cm.

Figure 10B:
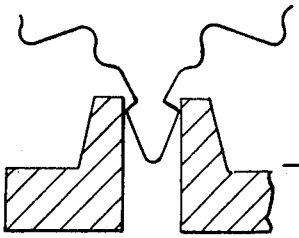
Figure 10C:
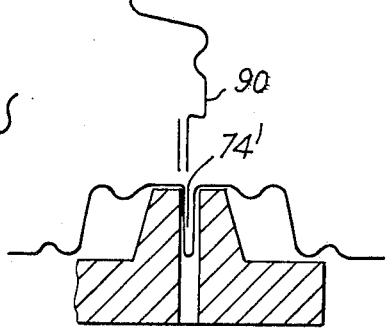
Figure 13:
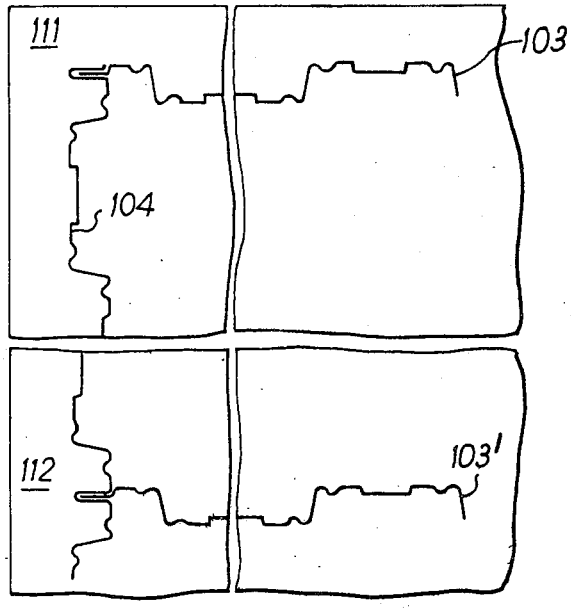
FIG. 13 is a broken view in horizontal section illustrating details of the element shown in FIG. 11.

As shown in FIG. 13 the longitudinal web sheets 103, 103′ are connected to the transverse sheets 104 by channels formed in the latter in the manner described above and illustrated in FIGS. 10*a* to *c*. The web sheets are thereafter locked together by means of several punched connections 130 formed as shown in detail in FIG. 14.

For forming the lock 130, in the clamped channel groove 74 with the edge of the web sheet 103 inserted, there is formed a curved projecting portion 137 by cutting the three layers along the lines 139, 139′ and pressing out the intermediate portion 137 like a bail, so as to permit the transfer of vertical forces V between the sheet 103 and the sheet 104 by mutual engagement of the edge faces cut in the various sheets.

This force-transmitting connection of the longitudinal and transverse web sheets gives the element 100 a great torsional resistance and permits i.a. the element to be supported at its short sides in points spaced from the terminal points of the longitudinal web sheets, in order to bridge window openings and the like.

When assembling an element as shown in FIG. 1 or FIG. 11 care should be taken to keep the sheets as nearly as possible in vertical positions between the flange plates before the compression starts. For this purpose supporting means may be placed on both sides of the sheets. Such means may take the form of removable rails on the outside and even on the inside of open-ended structures like that shown in FIG. 1, since such rails can be removed before the extremities are closed. In elements in which all the lateral faces have to be interconnected before compression, as is the case with the structure shown in FIG. 11, the supporting means must be left within the element, but if the element is filled with insulation as will mostly be the case, the insulating material itself may serve the purpose. If the panel is not to be filled with insulating material the webs may be supported internally by strips of cardboard or other cheap expendable material that are placed transversally between the longitudinal webs at intervals of, say, 1 m. Such strips should have a height somewhat less than the clear distance between the flange plates in the finished panel, and a length equalling the distance between adjacent longitudinal webs.

All the forms of webs and teeth that have been described and shown in the drawings have the common feature that the teeth extend over the full profile depth *d* of the web, as this gives the teeth the maximum strength and stiffness and completely eliminates the problem of tooth collapse. Clearly, however, there are tooth forms intermediate the two extremes shown in FIGS. 15 and 16 that will perform satisfactorily, even if the teeth do not extend over the full profile depth. It should be kept in mind that the transverse bending flexibility of the web strip, i.e. the ability of the web to adjust itself to the slightly S-shaped curvature shown in FIG. 16 depends strongly upon the web height (H in FIG. 2). In fact, the flexibility increases with the square of H. This means that the bending moment that the teeth must sustain in order to force the web into the curved shape decreases to one-fourth if the web height H is doubled. Therefore, a tooth shape that is inadequate for a low web, may perform satisfactorily for a higher web. The invention is therefore not limited by the strict requirement that the teeth shall extend over the whole profile depth, provided that the teeth in addition to being formed with at least two folds in alternating directions, have a certain minimum flat-width relative to their length, 1:1 being a practical minimum ratio.

On the whole, it will be understood that various modifications of the structures shown and described are possible and may appear to people skilled in the art without exceeding the scope of the invention as defined in the appended claims.

What I claim is:

1. A construction element comprisng two parallel plates of nailable material and at least one web element disposed between and perpendicular to said plates for interconnecting said plates in spaced apart relationship, said web element comprisng an elongated metal sheet having substantially trapezoidal corrugations with parallel sharp bends extending throughout the width thereof, said sheet having a plurality of spaced teeth lying in the same plane as said sheet and extending outwardly of opposite side edges thereof and embedded in said respective plates, said teeth along one of said edges being in transverse alignment with the teeth along the other of said edges, said sharp bends of said sheet extending into said teeth, and each said teeth having at least two sharp reverse bends extending likewise through the width of said sheet and being located at the transverse sections and at a portion of the longitudinal sections of the trapezoidal corrugations thereby forming teeth of Z-shaped cross-section.

2. The construction element according to claim 1, wherein said longitudinal sections of said sheet are each provided with a shallow groove.

3. The construction element according to claim 1, wherein a plurality of said web elements comprising said metal sheets are provided, said sheets being disposed along each of the sides of said plates and being sealingly engaged therewith, said sheets being interlocked together at right angles as an end of one of said sheets is engaged within a deformed U-shaped fold provided in another of said sheets so as to effect transmission of forces between said plates therealong.

4. A web element for use as a separating and shear-transmitting web in a construction element, comprising an elongated sinuous metal sheet having a plurality of spaced teeth lying in the same plane as said sheet and extending outwardly of opposite side edges thereof, said teeth along one of said edges being in transverse alignment with the teeth along the other of said edges, said sheet having transverse, parallel and spaced sharp bends extending throughout its width and into said teeth, each said teeth having at least two sharp reverse bends extending likewise through the width of said sheet thereby forming teeth of Z-shaped cross-section.

5. The web element accordng to claim 4 wherein each of said teeth have three sharp reverse bends extending likewise throughout the width of said sheet thereby forming teeth of W-shaped cross-section.

6. The web element according to claim 4 wherein each of said teeth have three sharp reverse bends extending likewise throughout the width of said sheet thereby forming teeth of V-shaped cross-section.

7. The web element according to claim 4 wherein said teeth have parallel side edges and saw-toothed terminal edges.

8. The web element according to claim 4 wherein the opposite side edges of the web between said teeth have a saw-toothed configuration.

9. The web element according to claim 4 wherein the width of said teeth as measured along the sinuous outline of the web is greater than their length.

10. The web element according to claim 4 wherein the depth of the tooth profile is substantially equal to that of the web.

11. A web element for use as a separating and shear-transmitting web in a construction element, comprising an elongated metal sheet having substantially trapezoidal corrugations with parallel sharp bends extending throughout the width thereof, said sheet having a plurality of spaced teeth lying in the same plane as said sheet and extending outwardly of opposite side edges thereof and adapted to be embedded in said respective plates, said teeth along one of said edges being in transverse alignment with the teeth along the other of said edges, said sharp bends of said sheet extending into said teeth, and each said teeth having at least two sharp reverse bends extending likewise through the width of said sheet and being located at the transverse sections and at a portion of the longitudinal sections of the trapezoidal corrugations thereby forming teeth of Z-shaped cross section.

12. The web element according to claim 11 wherein said longidutinal sections of said sheet are each provided with a shallow groove.

* * * * *